US005937892A

United States Patent [19]

Meisner et al.

[11] Patent Number: 5,937,892

[45] Date of Patent: Aug. 17, 1999

[54] SANITARY WATER VALVE

[75] Inventors: David Jay Meisner, Monmouth Beach; Thomas George Hart, North Brunswick, both of N.J.; Wilhelm Koch, Bongard, Germany; Heinrich Georg Mönch, Kenn, Germany; Jürgen Sponheimer, Leiwen, Germany

[73] Assignee: Ideal-Standard GmbH, Bonn, Germany

[21] Appl. No.: 08/532,680

[22] PCT Filed: Mar. 24, 1994

[86] PCT No.: PCT/DE94/00341

§ 371 Date: Dec. 27, 1995

§ 102(e) Date: Dec. 27, 1995

[87] PCT Pub. No.: WO94/24379

PCT Pub. Date: Oct. 27, 1994

[30] Foreign Application Priority Data

Apr. 8, 1993 [DE] Germany ..... 43 12 103

[51] Int. Cl.[6] ..... E03C 1/02

[52] U.S. Cl. ..... 137/375; 137/625.17; 137/801; 251/368

[58] Field of Search ..... 137/801, 375, 137/625.4, 625.17; 251/368

[56] References Cited

U.S. PATENT DOCUMENTS

| | | | |
|---|---|---|---|
| 2,654,390 | 10/1953 | Archer et al. | 137/801 |
| 4,103,709 | 8/1978 | Fischer | 137/801 |
| 4,884,596 | 12/1989 | Byers et al. | 137/801 |
| 4,979,539 | 12/1990 | Rohr | 137/625.4 |

FOREIGN PATENT DOCUMENTS

| | | | |
|---|---|---|---|
| 0495372 | 7/1992 | European Pat. Off. . | |
| 2172453 | 9/1973 | France . | |
| 7236632 | 10/1972 | Germany . | |
| 3513840 | 10/1986 | Germany . | |
| 3515718 | 11/1986 | Germany . | |
| 8712365 | 1/1988 | Germany . | |
| 1277203 | 6/1972 | United Kingdom | 137/801 |
| 2104625 | 3/1983 | United Kingdom . | |
| 2145499 | 3/1985 | United Kingdom . | |

*Primary Examiner*—A. Michael Chambers
*Attorney, Agent, or Firm*—Robert W. Becker & Associates

[57] ABSTRACT

A sanitary water valve in the form of a single shut-off valve or a mixing valve having one or more operating handles, especially a single-lever mixing valve with water passages and at least one water outlet. A valve body is provided that is made of a metal alloy that contains lead and that serves for receiving control components, especially components integrated into a cartridge. Water inlet lines are connected to the cartridge via an insert that is disposed adjacent to the cartridge. To prevent contact between water flowing through the parts of the valve that are made of brass alloys containing lead, the inner surfaces of the water passages are protected by a water proof protection made of lead-free material that is non-hazardous to health.

13 Claims, 7 Drawing Sheets

SANITARY WATER VALVE

BACKGROUND OF THE INVENTION

The invention relates to a sanitary water valve in the form of a single shut-off valve or a mixing valve with one or several operating handles, particularly a single-lever mixing valve with water passages in the form of water inlets and at least one water outlet or waterspout, and with a valve body for receiving the control elements which, in particular, are united within a cartridge as a constructional unit, with the inlet tubes that form the water inlets being connected to the cartridge via an insert piece arranged adjacent to the cartridge.

Because of the good processability and machinability, the relatively high strength, and the excellent corrosion resistance, sanitary combination sets for the inlet of cold, warm, and mixed water, are predominantly manufactured of copper-zinc alloys, also known under the name brass, to which lead is added as a further alloy component as a chip-breaking admixture for improving the chip removing processing. It is known and proven by scientific research that heavy metals getting into the human body can cause major permanent diseases.

Investigations have furthermore shown that particles of heavy metals, mainly lead, of water-leading pipes and combination sets made out of alloys containing lead, are received by the passing fresh water and, thus, are conveyed to the human organism via the drinking water. Because of the dangers in connection therewith, advances are made in some countries to prevent the application of sanitary combination sets of the so far used copper-zinc alloys containing lead. In some countries, therefore, sanitary combination sets of brass and other alloys that contain lead are undesirable if there is a danger that heavy metals, like lead, can be picked up by the water because of the contact of the water leading parts of a combination set with the passing water.

Apart from the common brass combination sets, sanitary combination sets are already suggested, the water-leading parts and functioning elements of which are essentially manufactured of materials non-hazardous to health. These developed combination sets, for example, pillar mixers, comprise an insert piece of a brass alloy into which the inlet pipes manufactured of copper for the cold and warm water, and, if applicable, an outlet pipe of copper, are pressure-tightly inserted. The cartridge made of plastic for the quantity and temperature control of the water is pressure-tightly stress-connected with this insert piece by anchor bolts, if applicable with an in-line arrangement of further functional groups. With these developed sanitary combination sets, the areas in which the water can come into contact with the constructional groups manufactured of a brass alloy, are greatly reduced. The reception of alloy particles hazardous to health by the water is, thus, indeed limited. Despite the wide-ranged securing of a high water quality, contact areas remain in the insert piece consisting of a copper-zinc alloy, in the area of the locations of contact of the pressure-tightly inserted inlet and, if applicable, outlet pipes for the cold, warm, and mixed water; in the contact areas, alloy particles hazardous to health can be picked up by the water. Although comparatively extremely low proportional quantities are involved, they can be detected with highly modern analytical measuring instruments and may possibly lead to detrimental consequences for the manufacturer.

It is an object of the invention to entirely eliminate the locations of contact between the water and the members consisting of a brass alloy and to create a sanitary combination set that is entirely "lead-free".

SUMMARY OF THE INVENTION

The water valve of the present invention is characterized primarily in that the inner surface means of the water passage means are protected by water proof protection means made of lead-free material that is non-hazardous to health in order to prevent contact of the inner surface means with water that is flowing through the water passage means.

In its basic idea, the invention suggests that the water passages, in order to prevent a contact with the water that flows through them, are provided at the interior with a waterproof protection consisting of a lead-free material non-hazardous to health. This has the advantage that a contact between the water and alloy members containing lead of the combination set are excluded.

According to a first advantageous embodiment of the invention, the protection consists of a coating of a lead-free material non-hazardous to health, applied to the interior surface of the water passages and, in addition, the insert piece for the connection of the inlet pipes consists of plastic; in this case, also so-called open cartridges can be applied in which case the water from the cartridge itself enters a water passage provided with an appropriate interior coating; since all the parts with which the water comes into contact consist of lead-free materials, there is no contact of the water with lead-containing members of the combination set.

An alternative embodiment of the invention suggests that the protection is embodied as a separate tube or hose-like water tube that is inserted into the water passage and is manufactured of a lead-free material non-hazardous to health, with this water tube being entirely sealed against groups of members or functional groups which consist of a brass alloy containing lead. According to one embodiment of the invention, the separate water tube, as well as the inlet pipes, are connected with the cartridge via an additional opening in the insert piece so that the mixed water enters the separate water tube directly from the cartridge and is then guided toward the outlet head without coming into contact with parts of the combination set which contain lead.

As already mentioned, the insert pieces for the connection of the inlet pipes, as a rule, consist of a brass containing lead, and for preventing a contact of the water with the brass containing lead in this area, an embodiment of the invention suggests to provide and pressure-tightly stress-connect a disc of a material non-hazardous to health between the cartridge and the insert piece consisting of a brass containing lead, for connecting the inlet pipes and the separate water tube with respective sealing elements being included; this ensures that the inlet pipes as well as the separate water tube penetrate through the insert piece consisting of brass containing lead and only open into the cartridge via the disc arranged in between, with additional sealing elements being provided between the disc and the insert piece and preventing a back flow of the water from the cartridge to the insert piece via the disc. According to an embodiment of the invention, the disc arranged in between is manufactured of a corrosion-resistant steel so that it is capable of absorbing the forces that occur between the functional groups of members when they get stress-connected.

According to one embodiment, the sealing elements which are provided in that area of the connections of the insert piece in which the inlet pipes for the cold and warm water and the separate water tube are inserted, for example, by brazing, are preferably inserted into recesses of the insert piece and rest, after stress-connecting the cartridge with the insert piece, against the surfaces of the recess in a leak-proof manner, encompassing the inserted tubes.

At the end portion facing the outlet of the separate water tube, an outlet head is provided that is form-fittedly connected with the valve body, with a sealing element being arranged in between.

The outlet head is slipped onto the separate water tube by means of a cylindrical seal and protrudes through an opening portion of the valve body, with the sealing element being provided with two outer circular shoulders, in between which the receiving member of the outlet head is received and fixedly position-secured.

In a modified embodiment of this attachment, the outlet head is provided at the inlet side with a cylinder-shaped extension of its receiving portion with an inwardly facing catching projection that engages a corresponding opening portion of the valve body. The pressure-tight connection between the outlet head and the end portion facing the outlet of the separate water tube is again secured by a cylinder-shaped sealing element that is provided with an outer circular shoulder which radially rests in an abutting manner in a receiving hole of the outlet head and is provided with a further inner circular shoulder that rests with its inward portion against the end-face of the separate water tube or of an inserted transition piece and with its outer end face against an end portion of the receiving hole of the outlet head.

With pillar mixers that are provided in between the cartridge and the insert piece with a liquid distributor that is encompassed by a plastic casing and is, together with the insert piece, inserted into a base body of the valve body, the end portion facing toward the inlet of the separate water tube is again inserted pressure-tightly into an outlet opening of the plastic casing with the help of a cylinder-shaped sealing element. Additional sealing members are inserted into corresponding recesses of the insert piece and encompass the inlet pipes when the cartridge, the liquid distributor, and the insert piece are pressure-tightly stress-connected, and ensure a leak-proof insulation between the insert piece manufactured of a brass alloy and the water-leading functional elements.

The cylinder-shaped sealing element inserted into the outlet opening of the plastic casing of the liquid distributor is again provided with an outer circular shoulder that rests against the end face and/or within a recess of the outlet opening in an abutting manner and an inner circular shoulder which delimits the inserting depth of the outlet pipe into the plastic casing.

The suggested embodiment according to the invention for a sanitary water valve, particularly for pillar mixers of the most various embodiments, on the one hand takes advantage of the advantageous features of brass alloys for certain functional constructional groups, like, for example, their relatively high strength and their good qualities for processing and machining and ensures with the application of relatively simple means that any contact of the water with these functional constructional groups is excluded. Since all of the groups of members or functional groups that are water-leading or come into contact with water are manufactured of materials non-hazardous to health or are provided with an appropriate coating, a sanitary water valve is thus created with which the possibility of a picking-up of heavy metal alloy particles by the water is entirely excluded.

BRIEF DESCRIPTION OF THE DRAWINGS

The invention is described in detail with the help of the following embodiments; the corresponding drawings illustrate.

DESCRIPTION OF PREFERRED EMBODIMENTS

Figure 1:
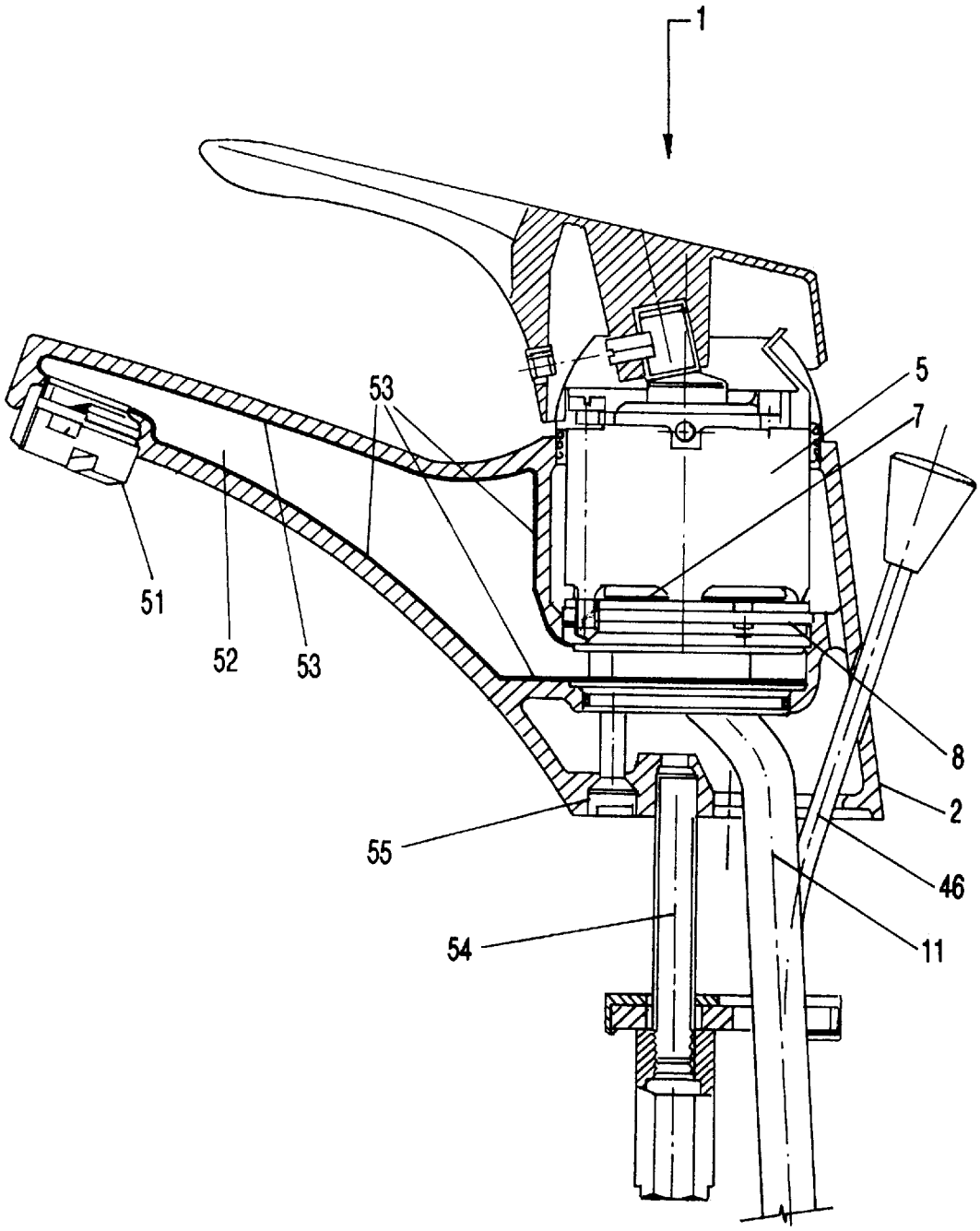
FIG. 1 a pillar mixer with a closed valve body of a brass alloy containing lead, FIG. 2 a pillar mixer, the water passages of which are penetrated by a separate water tube, with an outlet head that is mounted onto the separate water tube, FIG. 3 an enlarged illustration of the connection between outlet head and separate water tube, FIG. 4 a pillar mixer with a liquid distributor arranged between the mixing cartridge and the insert piece and with a separate water tube that is attached to the plastic housing of the liquid distributor, FIG. 5 an enlarged illustration of the arrangement of the outlet head on top of the separate water tube of the combination set according to FIG. 4, FIG. 6 an enlarged illustration of the arrangement of the liquid distributor within the combination set according to FIG. 4 and the attachment of the separate water tube to the plastic housing of the liquid distributor, FIG. 7 a pillar mixer with a removable spray head, with the connection between combination set and spray head being effectuated via a flexible outlet pipe.
Figure 2:
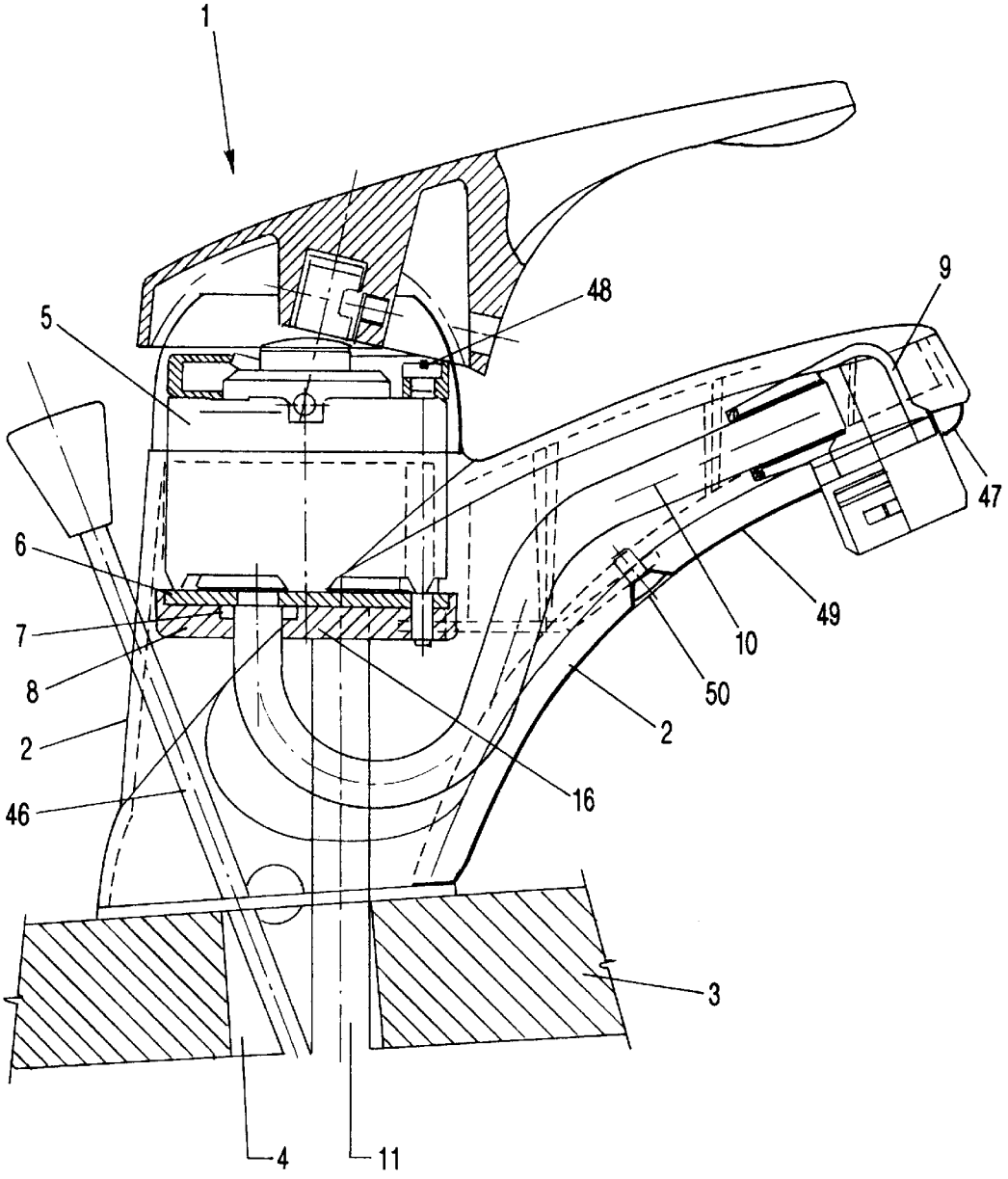

A pillar mixer 1 embodied according to the invention as illustrated in FIGS. 1 and 2, with an actuating rod 46 for an outlet valve, is inserted with its inlet pipes 11 for cold and warm water into a location hole 4 of a wash-bowl or sink 3 and is fixedly connected—via a tension rod 54—with the wash-bowl/sink 3 (FIG. 2).

The pillar mixer 1 according to FIG. 1 comprises a closed valve body 2 of a brass alloy containing lead into which an insert piece 8 that is pressure-tightly connected with the cartridge 5 is inserted and is screw-connected to the valve body 2 by a bolt 55. At the outlet of the valve body 2, an outlet head 51 is attached of a material that is non-hazardous to health and the water passage 52 between the outlet head 51 and the insert piece 8 is provided with a waterproof coating of a lead-free material that is non-hazardous to health. The coating 53 can, for example, be applied in a dipping method. The inlet pipes for cold and warm water are pressure-tightly inserted into the insert piece 8 that consists of a plastic material, with respective additional sealing elements 7 being provided at the connecting areas of those pipes. By stress-connecting the cartridge 5 with the insert piece 8, a leak-proof connection is achieved in conjunction with the sealing elements.

In this embodiment, the water is guided via the plastic insert piece 8 into the cartridge 5 and from here again via the insert piece 8 into the water passage 52 within which it flows to the outlet head 51; since the inner surface of the outlet belonging to the valve body 2 is provided with a coating 53 of an appropriate material, there is no area in which the water gets into contact with alloy members containing lead.

In FIG. 2 an embodiment of the invention is illustrated in which a separate water tube 10 of a material non-hazardous to health is provided between the cartridge 5 and the outlet head 9 in order to prevent contact between the water and alloy members consisting of brass that contains lead. The inlet pipes 11 for the cold and warm water and the separate water tube 10, which for example, consist of copper, are first inserted pressure-tightly by brazing into the insert piece 8 consisting of a brass alloy in this case. For connecting the pipes 10, 11 with the cartridge 5, however, an additional disc 6 of a material non-hazardous to health, preferably a corrosion-resistant steel alloy, is provided between the insert piece 8 and the cartridge 5, with the pipes 10, 11 penetrating through the insert piece 8 into the disc 6 and being supported there; between the disc 6 and the insert piece 8, additional sealing elements 7 are provided which are inserted into recesses 16 of the insert piece 8; after stress-connecting the insert piece 8 with the cartridge 5 manufactured of a ceramic or plastic material and the disc inserted between the insert piece 8 and the cartridge 5, the sealing elements 7 encompass the pipes 10, 11 in a leak-proof manner with the help of the tension rod 48 and abut against the surfaces of the recesses 16 in a leak-proof manner. This ensures that any contact of the passing water with the insert piece 8 manufactured of a brass alloy is prevented and that, thus, no alloy particles which may endanger health are being picked up by the water and may reach the human organism via the drinking water.

Figure 3:
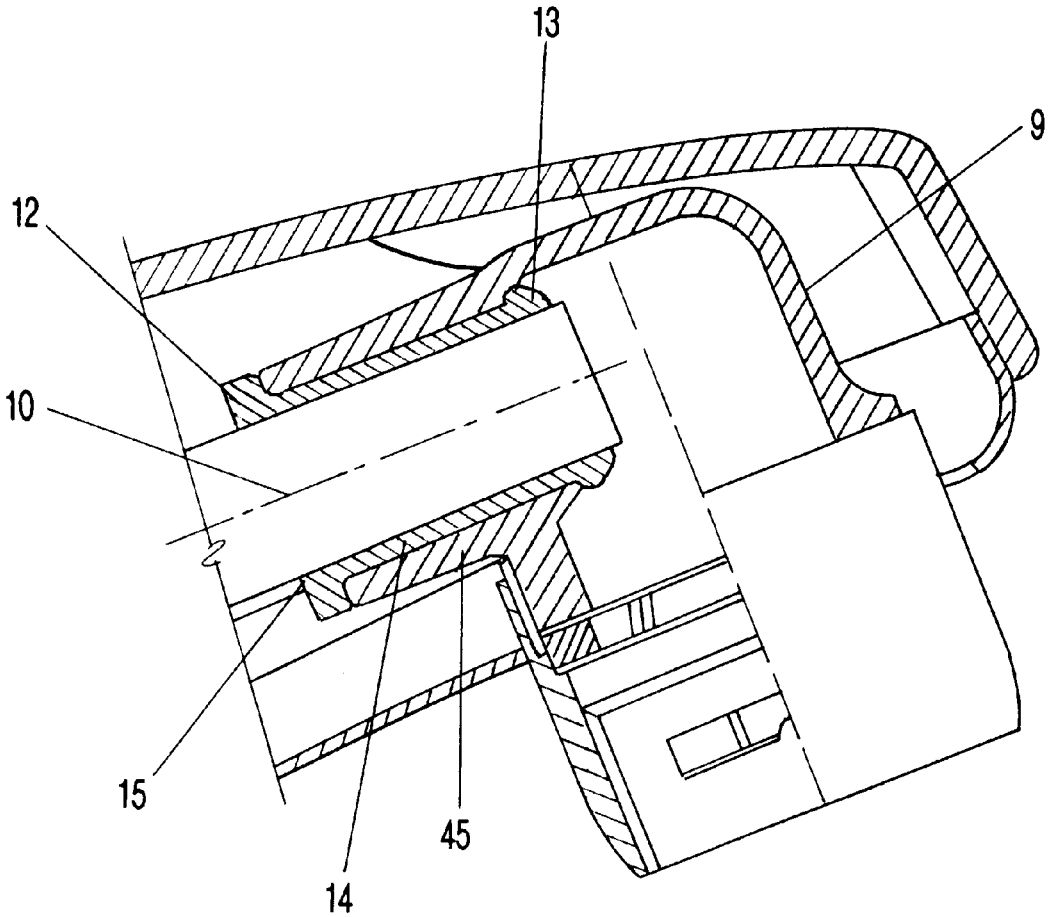

As can be seen more clearly in FIG. 3, an outlet head 9 that protrudes through an opening 47 of the valve body is slipped onto the end portion facing toward the outlet of the separate water tube 10, with the help of a cylinder-shaped sealing member 14. In the present embodiment, this portion of the valve body 2 is embodied as a blind 49 that, for example, is chromium-plated like the valve body 2 and is connected to the valve body 2 by a screw.

The sealing member 14 has two outer circular shoulders 12, 13 in between which the receiving member 45 facing toward the inlet of the outlet head 9 is provided pressure-tightly and position-securedly. The sealing member 14 is furthermore provided with an introduction slant 15 that facilitates the slipping-on of the sealing member 14 together with the outlet head 9 onto the separate water tube 10. In accordance with the subject of the present invention, the outlet head 9 is also manufactured of a material non-hazardous to health, preferably of plastic.

Figure 4:
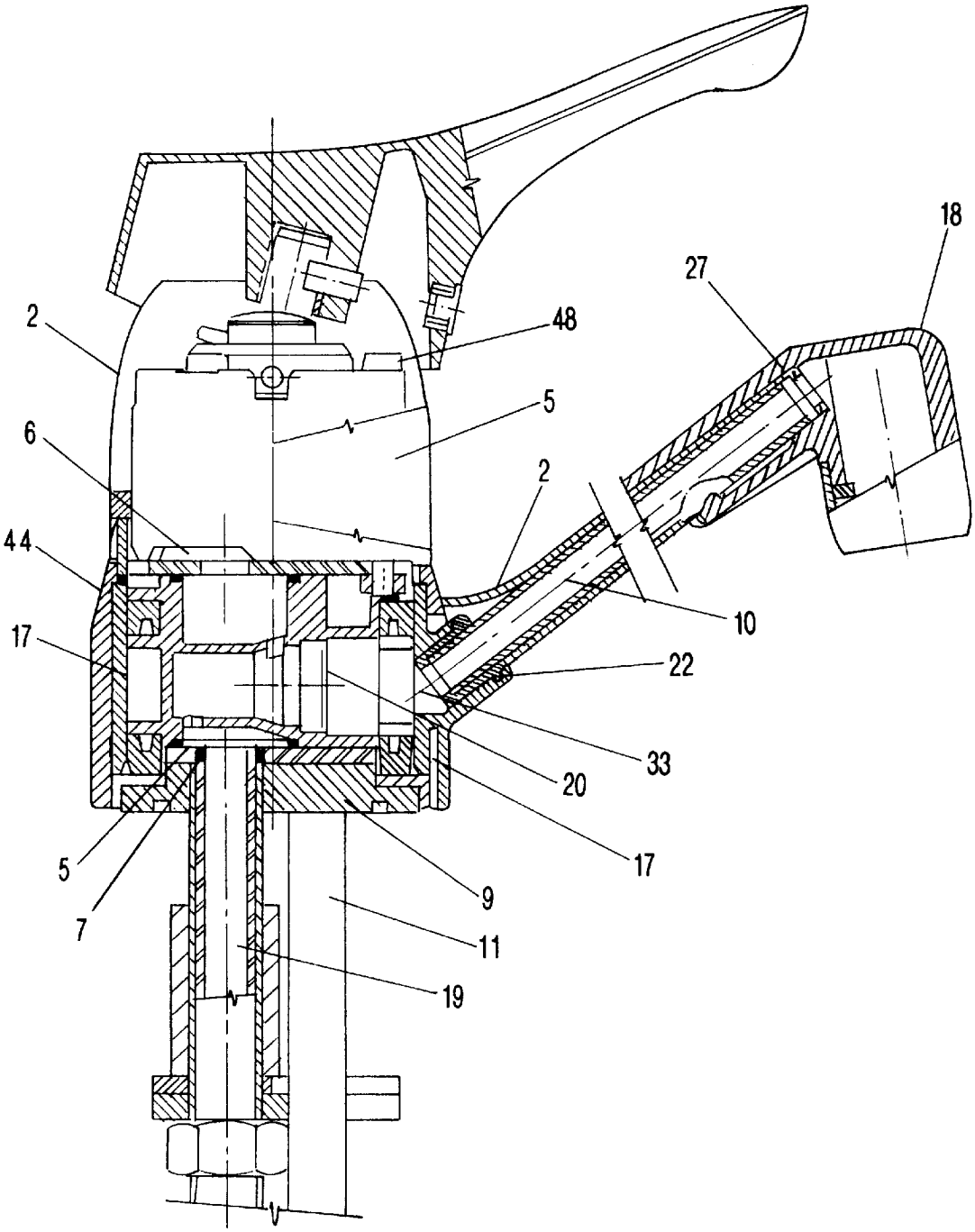

FIG. 4 shows a pillar mixer 1 that is provided with a liquid distributor 20 with which a switching of the water flow can be carried out between the outlet head that is a portion of the combination set 1 and that is indicated by 18 in this case and a separate outlet device, for example, in the form of a removable spray head that can be provided in addition to the combination set 1 and that is connected with the cartridge 5 via a further tube 19. The liquid distributor 20 is pressure-tightly inserted into a plastic casing 17 provided with an outlet opening 23 and is positioned between the insert piece 8 that also in this case consists of a brass alloy and the cartridge 5 with an in-line arrangement, in this case of two discs 6 of a corrosion-resistant steel alloy and is together with these groups of members stress-connected by tension rods 48 in a manner known per se. The inlet pipes 11, as well as the further tube 19 provided for the mixed water and leading toward the separate outlet device, again are inserted into the insert piece 8, with sealing elements 7 that are inserted according to the invention in the area of the connecting surfaces of the disc 6 and that are stress-connected together with the aforementioned groups of members and that secure a leak-proof connection between the water leading members and the insert piece.

Figure 5:
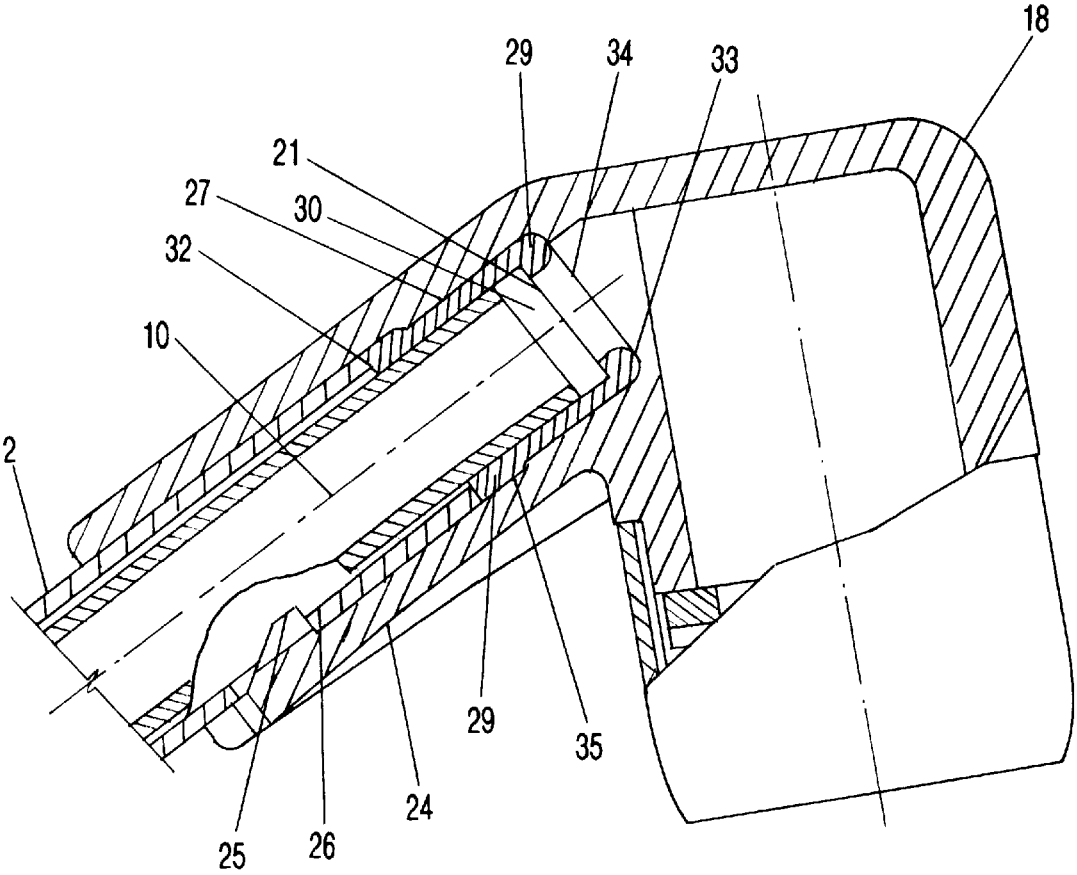
Figure 6:
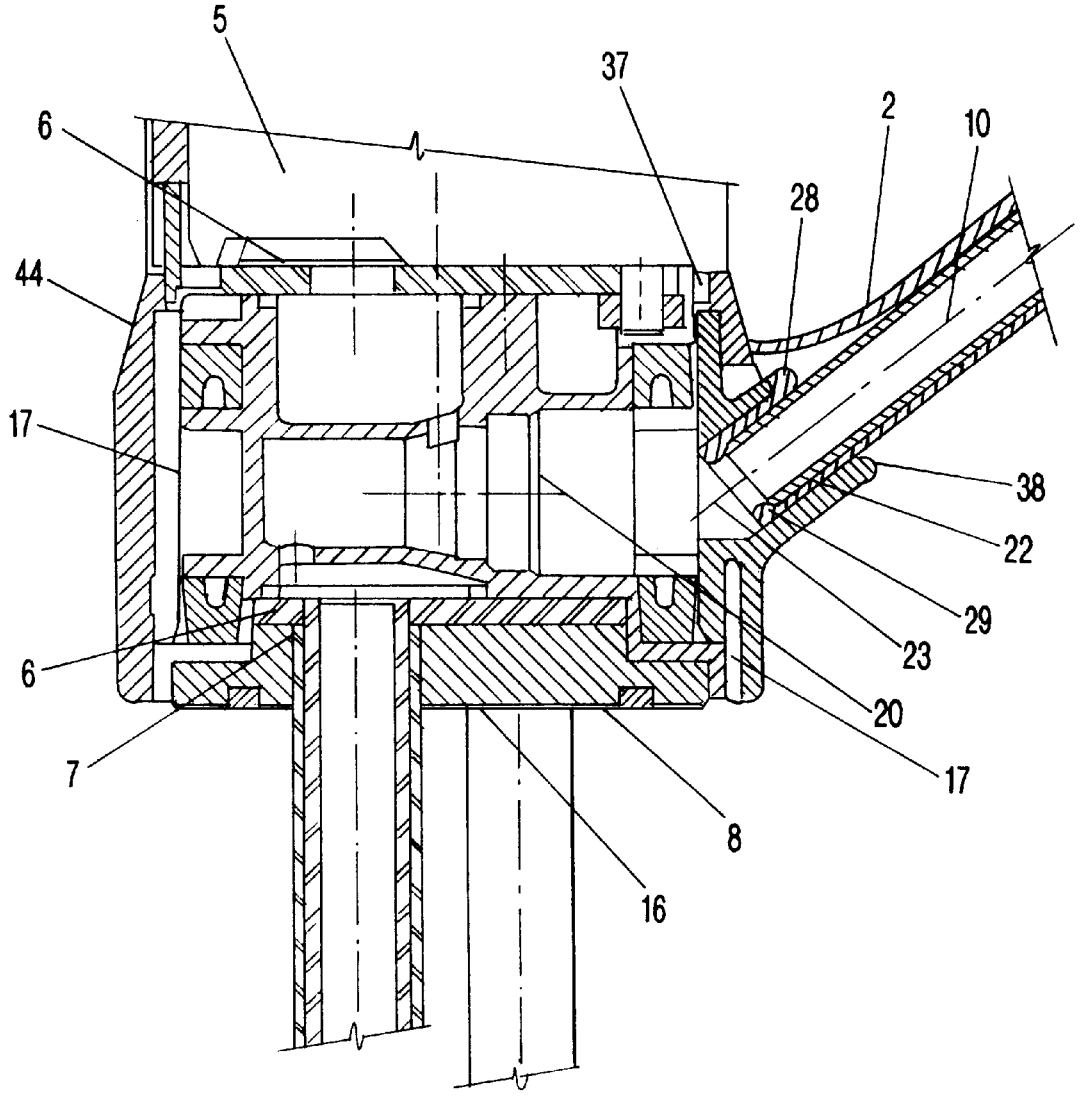

By means of a cylindrical seal 22, the separate water tube 10 is pressure-tightly inserted with its end facing the inlet, into the outlet opening 23 of the plastic casing 17, whereas an outlet head 18 is also pressure-tightly slipped onto the end portion of the separate water tube 10 facing the outlet by means of a cylinder-shaped seal 27 and is form-fittedly connected with the valve body 2. For this purpose, the outlet head 18—as can be seen in detail in FIG. 5—is provided at its end facing the inlet with an extension 24 that is provided with a catching projection 25. The catching projection 25 engages an open portion 26 of the valve body 2 and thus guarantees a position-secured fixed location of the outlet head 18. The cylinder-shaped seal 27 for the pressure-tight connection of outlet head 18 and separate water tube 10, is provided with an outer circular shoulder 28 that radially abuts the receiving hole 35 of the outlet head 18 and it is furthermore provided with an inner circular shoulder 29 abutting with its inward portion 21 the end face of the separate water tube 10, respectively, an inserted transition piece 30 and resting with its outer end face 34 against an end portion 33 of the receiving hole 35 of the outlet head 18. The slant portion 32 of the seal 27 facing toward the inlet, again facilitates the slipping-on of the outlet head onto the separate water tube 10. The seal 22 with which the end portion of the separate water tube 10 facing the inlet is inserted into the outlet opening 23 of the plastic casing 17, has an analogous configuration as the seal 27 has at the outlet end. The outer circular shoulder 28 of the seal 22 pressure-tightly abuts the end face 37, respectively the recess 38 of the outlet opening 23, whereas the inner circular shoulder 29 delimits the inserting depth of the outlet tube 10 into the plastic casing 17. The insert piece 8 is inserted into a base body 44 of the valve body 2 together with the liquid distributor 20 provided in the plastic casing 17 and with the cartridge 5 that is stress-connected with the insert piece 8; a corresponding illustration hereof is shown in FIG. 6.

Figure 7:
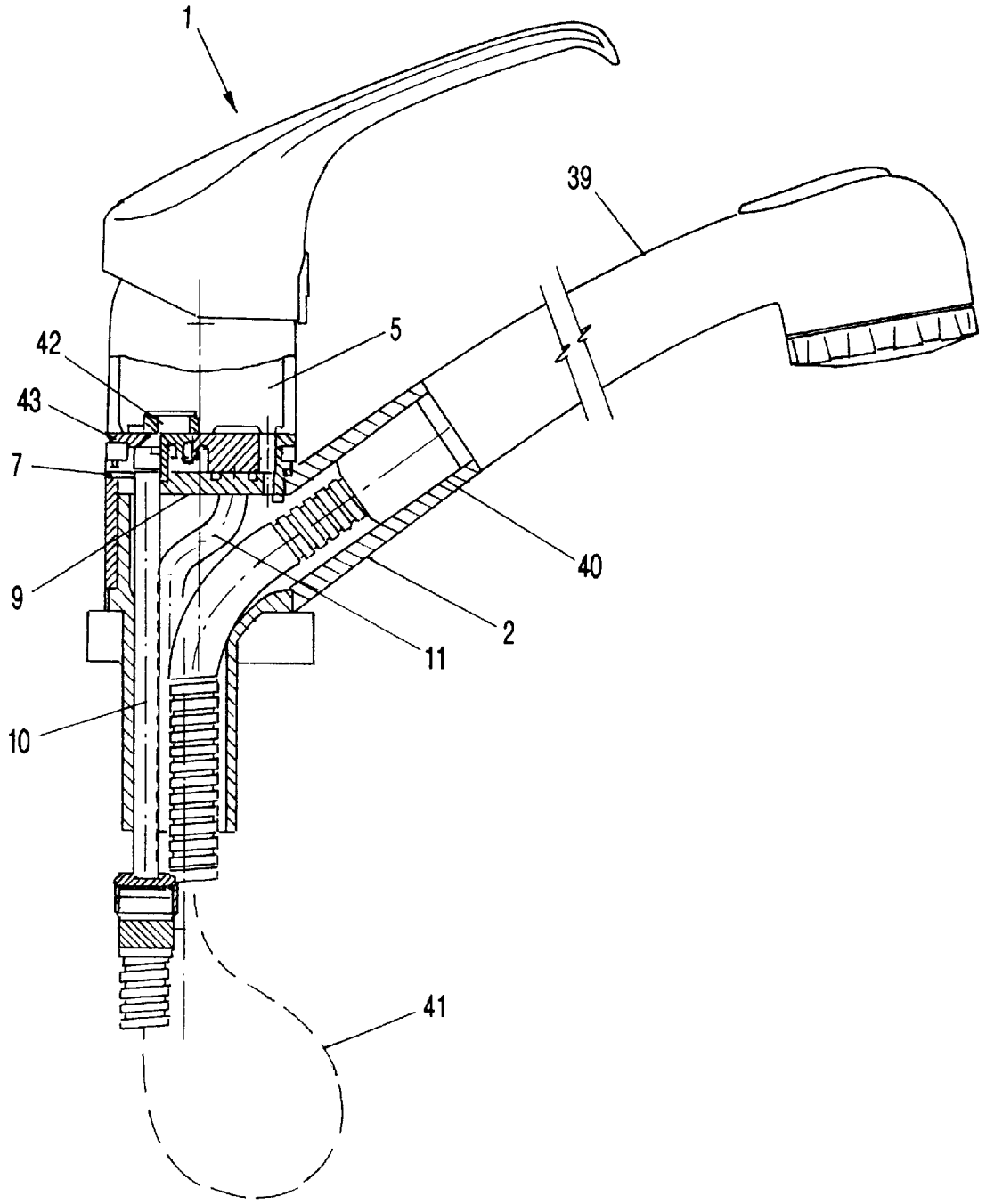

The pillar mixer 1 illustrated in FIG. 7 is provided with a removable spray head 39 that is inserted into a receiving portion 40 of the valve body 2 and is connected with the additional water tube 10 via a flexible connecting tube 41. The separate water tube 10 and the inlet pipes 11 are again pressure-tightly inserted into the insert piece 8 consisting of a brass alloy, with additional sealing elements 7, as earlier described, being provided in the area of the connections. In this embodiment of the pillar mixer 1, a ventilation element 43 with a valve arrangement is provided between the insert piece 8 and the cartridge 5. The cartridge 5, the ventilation element 43, and the insert piece 8 are stress-connected with one another in a manner known per se such that a pressure-tight connection is created among the above-mentioned groups of members and that the additional sealing elements 7 at the connecting areas of the inlet pipes 11 and the separate water tube 10 secure a leak-proof connection that prevents any contact of the passing water with the insert piece 8 that is manufactured of brass.

The features of the subject disclosed in the above description, the patent claims, the abstract, and the drawing can, alone or also in any combination with one another, be essential for the realization of the invention in its various embodiments.

Therefore, the present invention is in no way restricted to the specific disclosure of the specification and drawings, but also encompasses any modifications within the scope of the appended claims.

We claim:

1. A sanitary water valve in the form of a single shut-off valve or a mixing valve having one or more operating handles, including water passage means and at least one water outlet means, and a valve body that is made of a metal alloy that contains lead and that serves for receiving a cartridge that contains control elements, water supply means being connected to said cartridge via an insert that is disposed adjacent to said cartridge, said cartridge communicating with said water passage means, comprised wherein inner surface means of said water passage means are protected by waterproof protection means made of lead-free material that is non-hazardous to health in order to prevent contact of said inner surface means with water that is flowing through said water passage means, wherein said protection means comprises a separate tubular water line that is made of lead-free material and is non-harzardous to health and that is disposed in said water passage means, said separate water line being entirely sealed off relative to components of said water valve that are made of said lead-containing alloy, wherein said insert is made of lead-containing brass, wherein to connect said water supply means and said separate water line, a disc that is made of lead-free material that is non-hazardous to health is provided and wherein means are provided that, via the interposition of sealing means, effects a pressure-tight disposition of said disc between said cartridge and said insert.

2. A water valve according to claim 1, wherein said insert for connection of said water supply means is plastic.

3. A water valve according to claim 1, wherein said insert is provided with aperture means to effect a connection of said separate water line to said cartridge.

4. A water valve according to claim 1, wherein said disc is made of stainless steel.

5. A water valve according to claim 1, wherein said insert is provided with recesses for receiving said sealing means, and wherein after installation, said sealing means surround said separate water line and said water supply means in a water-tight manner and rest against surfaces of said recesses in a water-tight manner.

6. A water valve according to claim 1, wherein an outlet head is disposed on an outlet end of said separate water line, said outlet head being positively connected to said valve body via the interposition of a sealing member.

7. A water valve according to claim 6, wherein an inlet end of said outlet head is provided with a cylindrical extension having an inwardly directed catching projection that is adapted to engage a corresponding opening of said valve body.

8. A water valve according to claim 6, wherein a cylindrical sealing element is disposed at a connection location between said separate water line and said outlet head, said sealing element having an inwardly facing slanted portion and an outwardly facing annular shoulder that rests in a recess of said outlet head, said sealing element having an inwardly facing annular shoulder, a portion of which rests against an end face of said separate water line or of an intermediate piece disposed on said end face, an outer end face of said sealing element resting against a shoulder of said recess of said outlet head.

9. A water valve according to claim 6, wherein said sealing member between said separate water line and said outlet head is provided with an inwardly facing slanted portion and two outwardly facing annular shoulders between which is disposed a receiving member on an inlet portion of said outlet head in a pressure-tight and position-centered manner.

10. A water valve according to 6, wherein all of said sealing means and members and said outlet head are made of lead-free material that is non-hazardous to health.

11. A water valve according to claim 1, wherein a venting element that is provided with a valve arrangement is disposed between said cartridge and said insert and is pressure-tightly disposed in said insert along with sealing means.

12. A water valve according to claim 1, wherein said valve body includes a base body, and wherein a liquid distributor is disposed in a pressure-tight manner in a plastic housing that via the interposition of stainless steel discs is tightly disposed between said cartridge and said insert, said separate water line being disposed in said plastic housing of said liquid distributor in a pressure-tight manner, and said plastic housing together with said cartridge and said insert being disposed in said base body of said valve body.

13. A water valve according to claim 12, wherein said separate water line is disposed in an outlet connection of said plastic housing via the interposition of a sealing element having an inner annular shoulder for limiting the extent of insertion of said separate water line into said plastic housing, said sealing element also having an outer annular shoulder resting against an end face and/or recess of said outlet connection.

* * * * *